US009851687B2

(12) United States Patent
Huang

(10) Patent No.: US 9,851,687 B2
(45) Date of Patent: Dec. 26, 2017

(54) TONER CARTRIDGE FOR ELECTRONIC IMAGE FORMING APPARATUS

(71) Applicant: GENERAL PLASTIC INDUSTRIAL CO., LTD., Taichung (TW)

(72) Inventor: Shih-Chieh Huang, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 15/453,182

(22) Filed: Mar. 8, 2017

(65) Prior Publication Data

US 2017/0261919 A1 Sep. 14, 2017

(30) Foreign Application Priority Data

Mar. 10, 2016 (CN) ..... 2016 2 0183811 U

(51) Int. Cl.
*G03G 15/00* (2006.01)
*G03G 21/16* (2006.01)

(52) U.S. Cl.
CPC ..... *G03G 21/1647* (2013.01); *G03G 15/757* (2013.01); *G03G 21/1676* (2013.01)

(58) Field of Classification Search
CPC ..... G03G 15/757; G03G 21/1647; G03G 21/1676; G03G 21/1857; G03G 21/186; G03G 2221/1657
USPC ..... 399/167
See application file for complete search history.

(56) References Cited

U.S. PATENT DOCUMENTS

2015/0050048 A1* 2/2015 Huang ..... G03G 15/757 399/167
2015/0050050 A1* 2/2015 Huang ..... G03G 15/757 399/167
2016/0124383 A1* 5/2016 Ikeda ..... G03G 15/757 399/167 X

* cited by examiner

*Primary Examiner* — Sophia S Chen
(74) *Attorney, Agent, or Firm* — Muncy, Geissler, Olds & Lowe, P.C.

(57) ABSTRACT

A toner cartridge includes a case body having a side opening, a photosensitive roller disposed in the case body and having an imaginary axis, a transmitting assembly and a cover member. The transmitting assembly has an axial member and two engaging claws. Each engaging claw is rotatable between an opened and a closed positions and has a vertex; when the engaging claw is in the opened position, the vertex is defined with the imaginary axis a maximum distance away that is greater than a distance between any other position on the engaging claw and the imaginary axis. The axial member is insertable into the connecting hole in which the engaging claws in the opened position are accommodatable, and operators can directly mount the cover member on the side opening without closing the engaging claws, so that the procedure for mounting the cover member saves time and is convenient.

7 Claims, 8 Drawing Sheets

TONER CARTRIDGE FOR ELECTRONIC IMAGE FORMING APPARATUS

BACKGROUND OF THE INVENTION

1. Field of the Invention

The present invention relates generally to toner cartridge and more particularly, to a toner cartridge mounted in an electronic image forming apparatus.

2. Description of the Related Art

A conventional photosensitive drum disposed in a toner cartridge can process with charging, exposing, developing and transferring toner powders on a paper to copy document. The photosensitive drum mainly comprises a photosensitive roller disposed inside a case body of the toner cartridge and a transmitting assembly disposed at an end of the photosensitive roller. The case body of the toner cartridge has an opening, the transmitting assembly is extended through the opening and connected with a driving member disposed inside a housing of the electronic image forming apparatus, to transmit a rotational kinetic energy from the driving member to the photosensitive roller. The toner cartridge further has a cover member disposed at the opening, the cover member has a through hole. Therefore, when the transmitting assembly is extended through the opening, the transmitting assembly can insert into the through hole, and the cover member can be directly disposed at the opening with success.

Nowadays there may be many transmitting assemblies with different structures which have been developed. For example, a transmitting assembly has an axial member and two engaging claws rotatably disposed at the axial member, the two engaging claws can be opened or closed relative to the axial member; when there is no external force applied on the aforementioned transmitting assembly, the two engaging claws are in an opened position, meanwhile if it is tried to mount the cover member on the opening, part of structure of the cover member may be interfered with the engaging claws, and it is failed to mount the cover member. In order to overcome this situation, an operator has to close the two engaging claws first, and the cover member can be mounted on the opening. However, the procedure for mounting the cover member on the opening would take too much time and be inconvenient.

SUMMARY OF THE INVENTION

The present invention has been accomplished in view of the above-noted circumstances. It is an objective of the present invention to provide a toner cartridge, the procedure for mounting a cover member of which on an opening of the toner cartridge would save time and be convenient.

To attain the above objective, the present invention provides a toner cartridge, which comprises a case body, a photosensitive roller, a transmitting assembly and a cover member. The case body has an inner space and a side opening communicated with the inner space and outside. The photosensitive roller is disposed at the inner space and has an imaginary axis. The transmitting assembly has a gear member fixed at an end of the photosensitive roller, an axial member provided with an end disposed at the gear member, and two engaging claws rotatably disposed at the other end of the axial member, wherein the gear member and the axial member are coaxial with the photosensitive roller; each of the engaging claws is rotatable between an opened position and a closed position; each of the engaging claws is provided with a vertex; when the engaging claw is in the opened position, the vertex of the engaging claw is defined with the imaginary axis a maximum distance that is greater than a distance between any other position on the engaging claw and the imaginary axis, and the maximum distance is greater than a distance between any position on the engaging claw and the imaginary axis when the engaging claw is in the closed position. The cover member has a main body disposed at the side opening of the case body and abutted against the gear member, and a connecting hole located at the main body and configured in a way that the axial member is insertable into the connecting hole and the two engaging claws in the opened position are accommodatable in the connecting hole.

Accordingly, even though the two engaging claws of the transmitting assembly are in the opened position, the two engaging claws still can be accommodated in the connecting hole of the cover member and not interfered with the connecting hole. Therefore, during the procedure for mounting the cover member on the side opening of the case body, the operator would not need to close the two engaging claws, and the cover member still can be mounted on the side opening, so that the procedure for mounting the cover member may save time and be convenient.

DETAILED DESCRIPTION OF THE INVENTION

Figure 1:
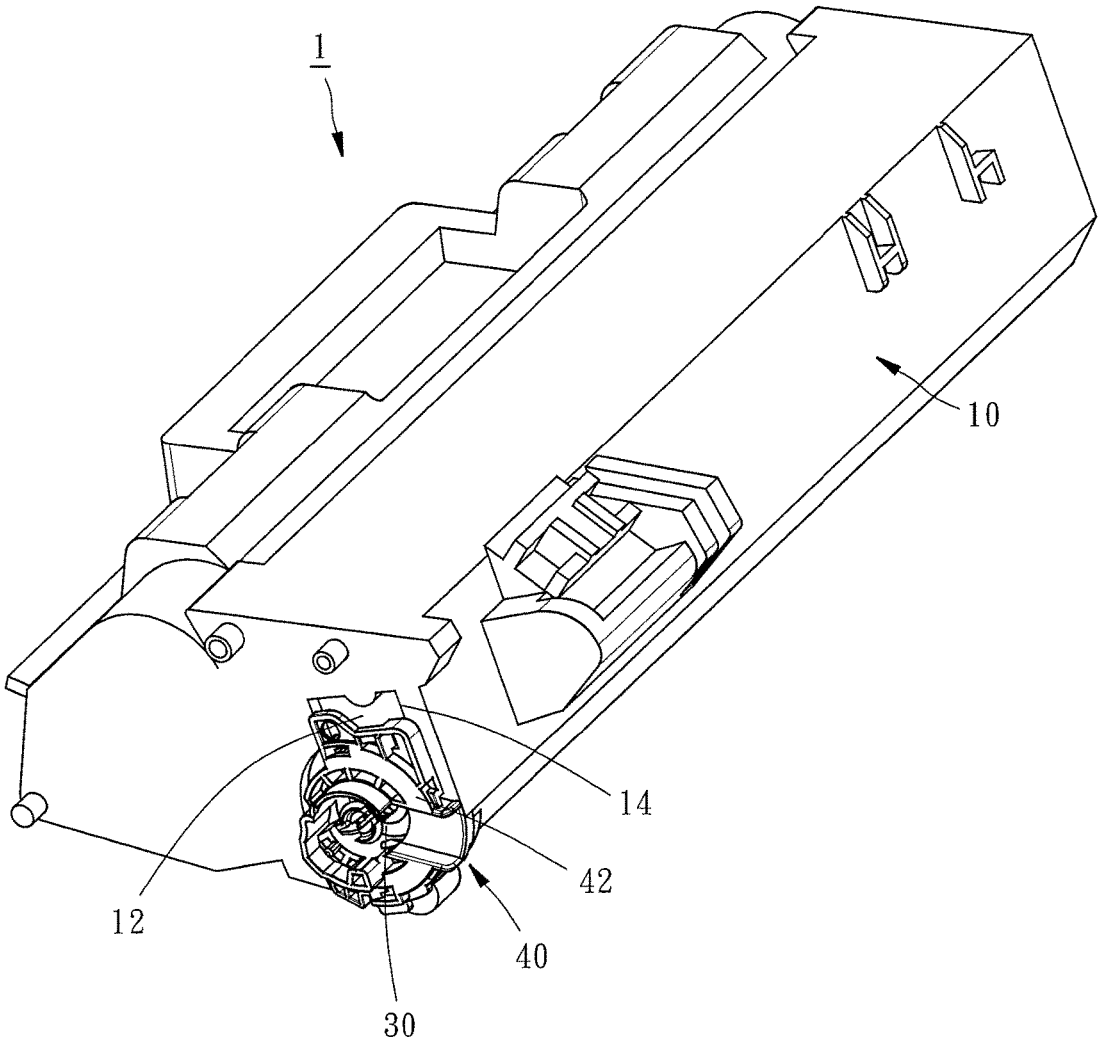
FIG. 1 is a perspective view of a toner cartridge according to a first preferred embodiment of the present invention.
Figure 2:
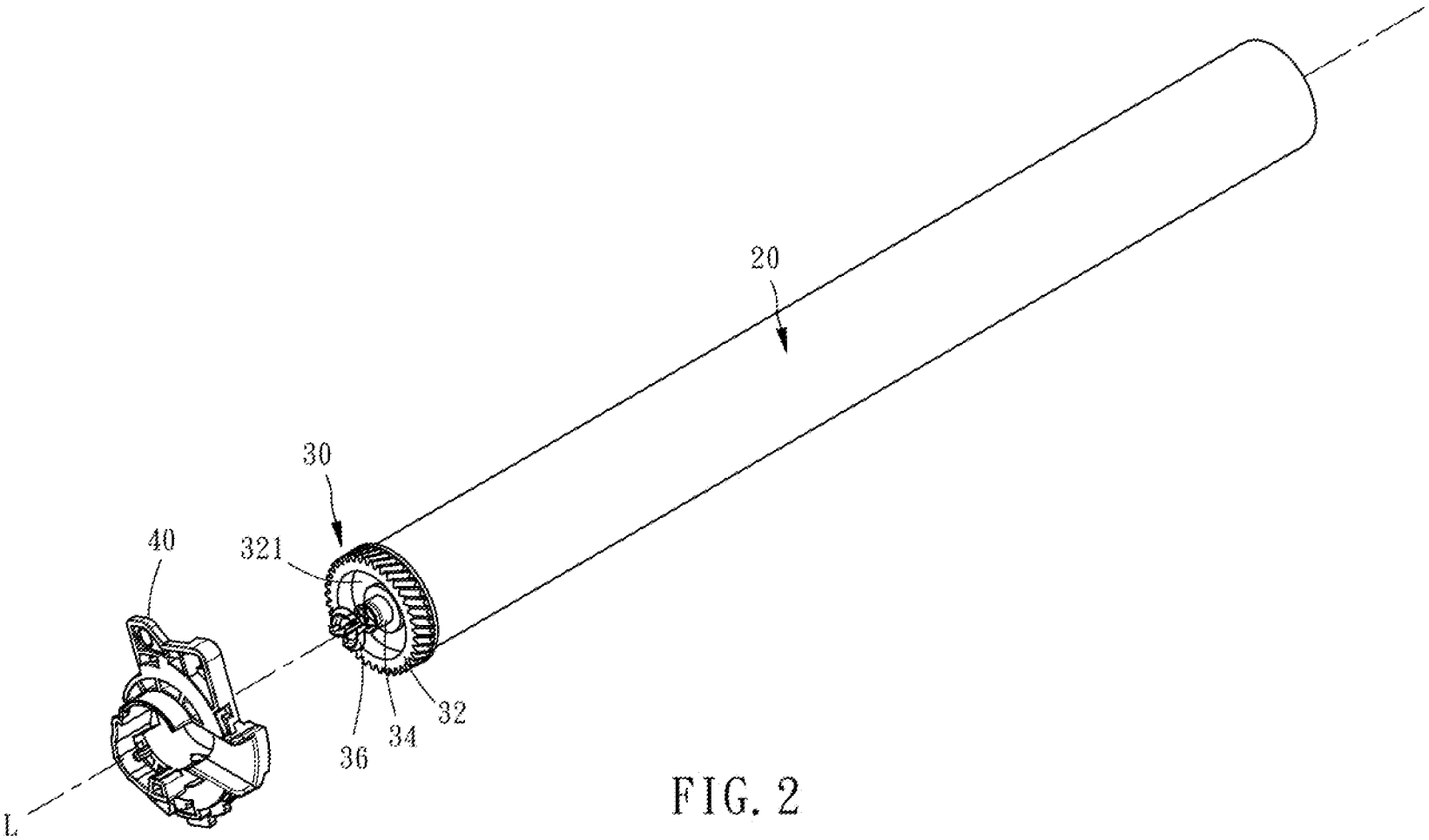
FIG. 2 is a perspective view of a photosensitive roller, a transmitting assembly and a cover member according to the first preferred embodiment of the present invention.

FIG. 1 illustrates a toner cartridge 1 according to a first preferred embodiment of the present invention. The toner cartridge 1 includes a case body 10, a photosensitive roller 20 (as shown in FIG. 2), a transmitting assembly 30 and a cover member 40. The toner cartridge 1 is adapted for being mounted in an electronic image forming apparatus (not shown).

The case body 10 has an inner space 12 in where toner is accommodated, and a side opening 14 communicated with the inner space 12 and outside, the said outside is referred as space outside of the case body 10.

The photosensitive roller 20 is disposed at the inner space 12 of the case body 10, the photosensitive roller 20 has an imaginary axis L and is rotatable along the imaginary axis L.

Figure 3:
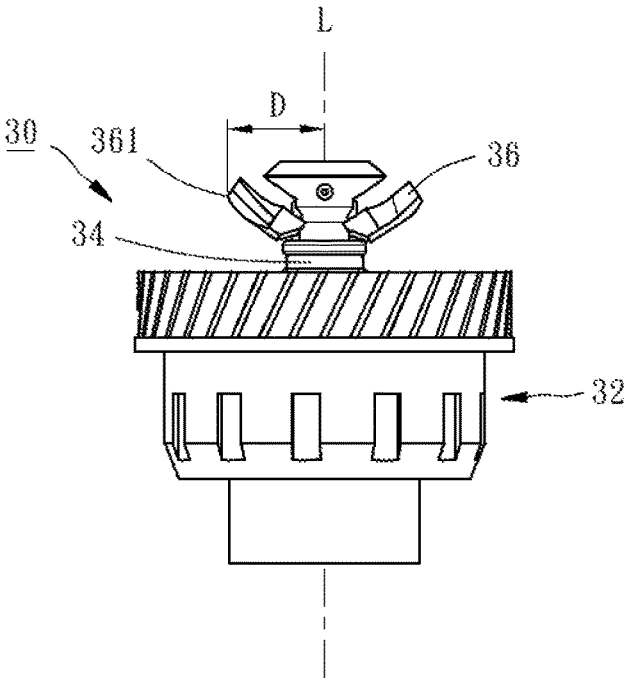
FIG. 3 is a side view of engaging claws of the transmitting assembly in an opened position according to the first preferred embodiment of the present invention.
Figure 4:
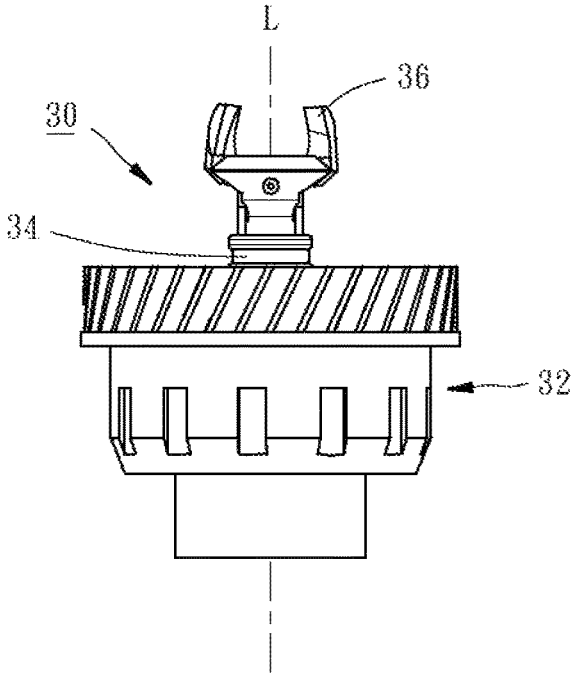
FIG. 4 is a side view of the engaging claws of the transmitting assembly in a closed position according to the first preferred embodiment of the present invention.
Figure 5:
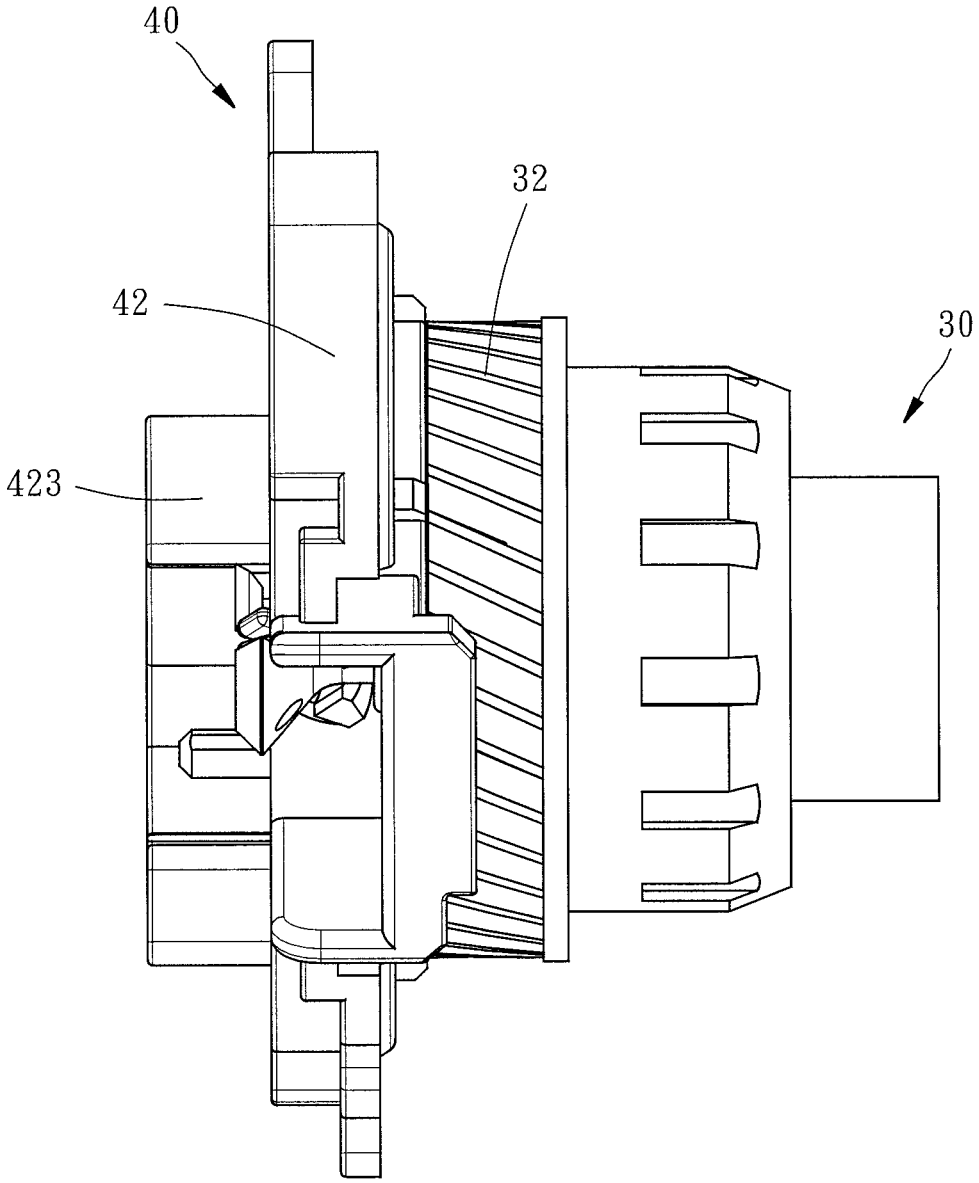
FIG. 5 is a side view of a gear member abutted against the cover member according to the first preferred embodiment of the present invention.
Figure 6:
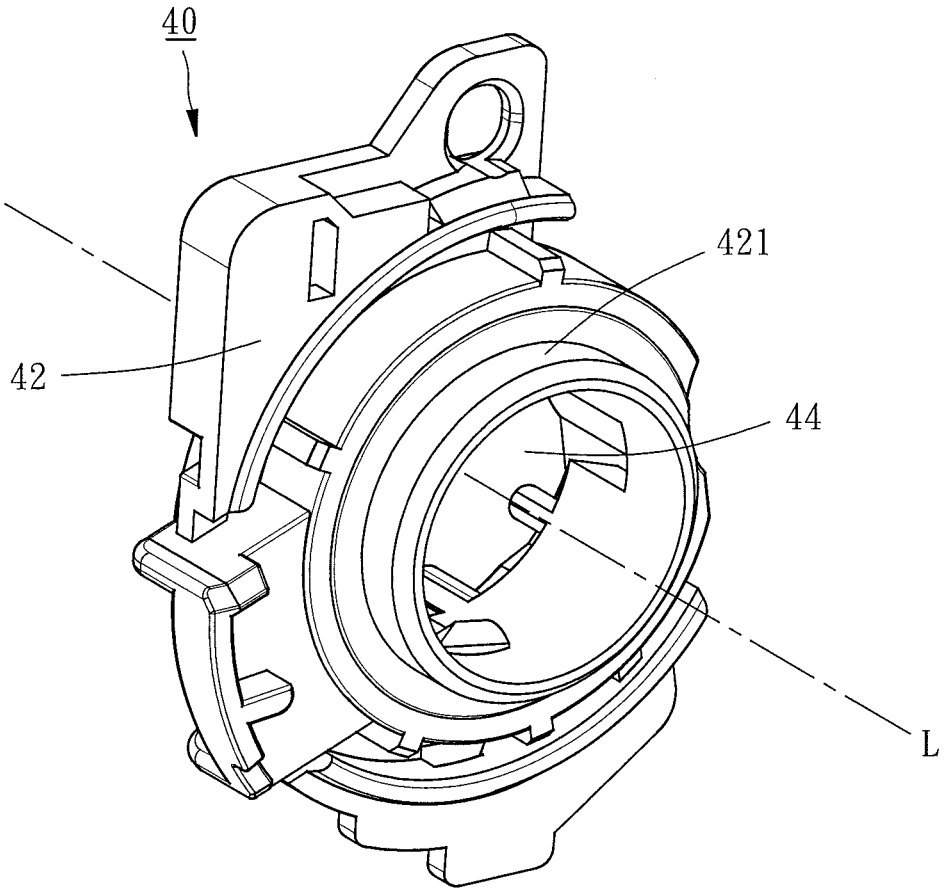
FIG. 6 is a perspective view of the cover member according to the first preferred embodiment of the present invention.
Figure 7:
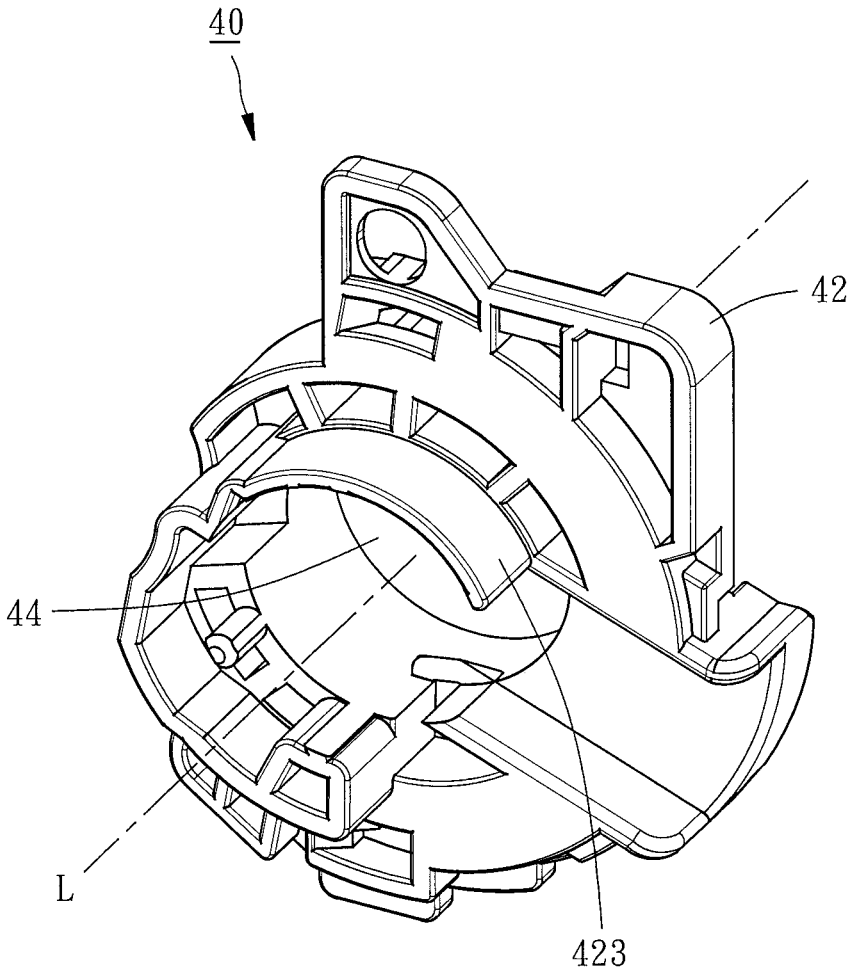
FIG. 7 is a perspective view of the cover member from another view angle according to the first preferred embodiment of the present invention.
Figure 8:
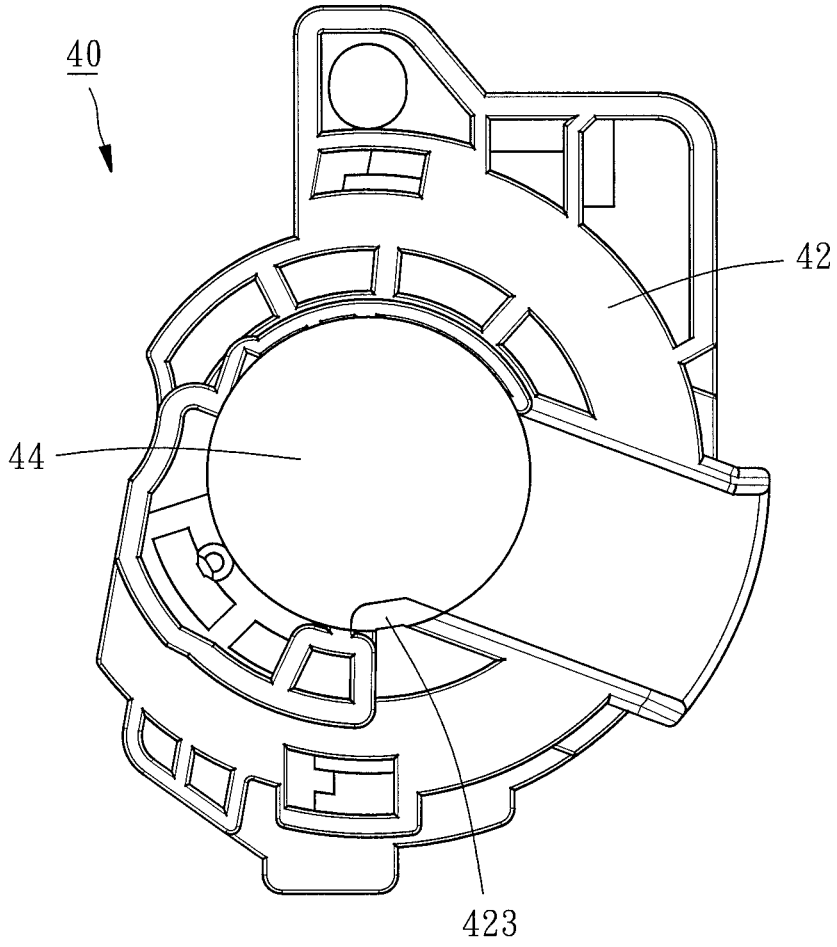
FIG. 8 is a front view of the cover member according to the first preferred embodiment of the present invention.

The transmitting assembly 30 has a gear member 32 fixed at an end of the photosensitive roller 20, an axial member 34 provided with an end movably or unmovably disposed at the gear member 32, and two engaging claws 36 rotatably disposed at the other end of the axial member 34. The gear member 32 and the axial member 34 are coaxial with the imaginary axis L of the photosensitive roller 20. The gear member 32 has an annular notch 321. Each of the engaging claws 36 is rotatable between an opened position (as shown in FIG. 3) and a closed position (as show in FIG. 4). Each of the engaging claws 36 is provided with a vertex 361; when the engaging claw 36 is in the opened position, the vertex 361 is defined with the imaginary axis L a maximum distance D that is greater than a distance between any other position on the engaging claw 36 and the imaginary axis L, and the maximum distance D is greater than a distance between any position on the engaging claw 36 and the imaginary axis L when the engaging claw 36 is at the closed position. The two engaging claws 36 are engageable with a driving member of the electronic image forming apparatus, so that a rotational kinetic energy of the driving member can be transmitted to the photosensitive roller 20 through the transmitting assembly 30 to rotate the photosensitive roller 20. When the two engaging claws 36 are not yet engaged with the driving member, the two engaging claws 36 are in the opened position; when the two engaging claws 36 engaged with the driving member, the two engaging claws 36 are in the closed position.

Figure 9:
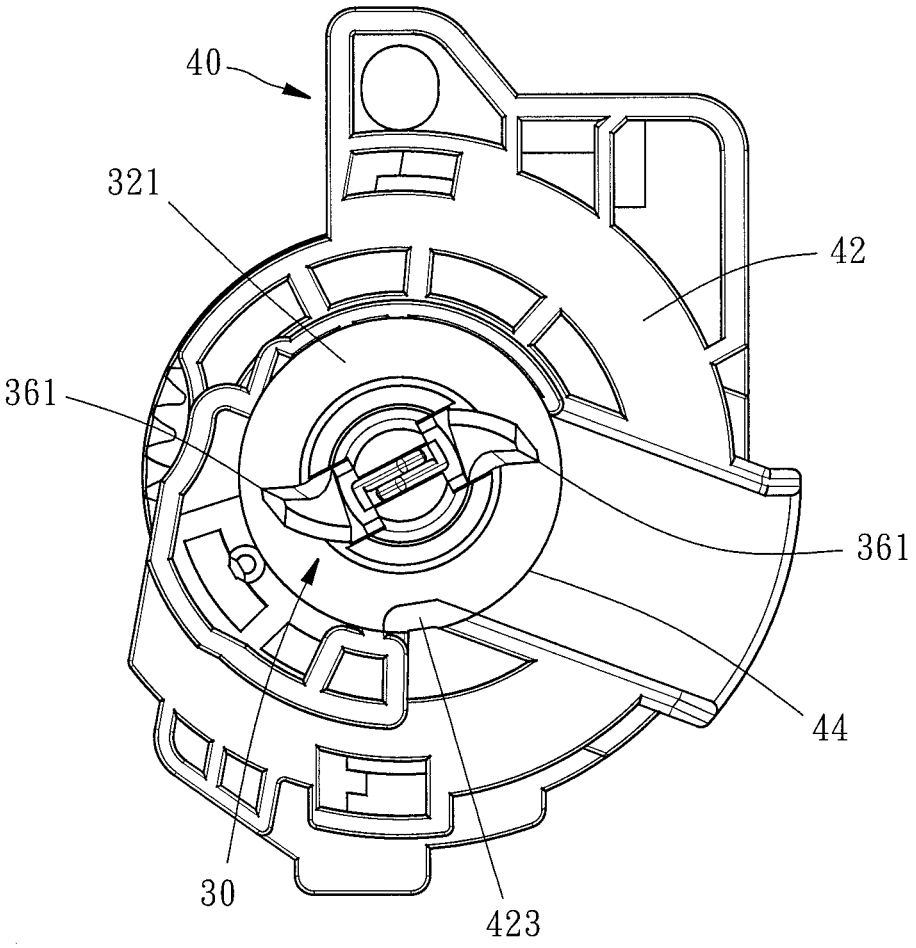
FIG. 9 is a front view of the cover member and the transmitting assembly according to the first preferred embodiment of the present invention.

Referring to FIGS. 1 and 5 to 9, the cover member 40 has a main body 42 disposed at the side opening 14 of the case body 10 and abutted against the gear member 32, and a connecting hole 44 located at the main body 42 and configured in a way that the axial member 34 is insertable into the connecting hole 44. A proximal side of the main body 42 adjacent to the gear member 32 has a tubular portion 421, a distal side of the main body 42 away from the gear member 32 has an extending portion 423, and inner edges of the tubular portion 421 and the extending portion 423 define the connecting hole 44. When the main body 42 is abutted against the gear member 32, the tubular portion 421 inserts into the annular notch 321 of the gear member 32, so that the gear member 32 is rotatable relative to the cover member 40. In the present embodiment, the tubular portion 421 is in a circular tubular shape, a nearest distance between the extending portion 423 and the imaginary axis L is smaller than (or equal to in other embodiment) a radius of the inner edge of the tubular portion 421, and the nearest distance between the extending portion 423 and the imaginary axis L is not less than the maximum distance D between the vertex 361 and the imaginary axis L when the two engaging claws 36 are in the opened position. Accordingly, the two engaging claws 36 in the opened position (as shown in FIG. 9) is accommodatable in the connecting hole 44. In other embodiments, the shape of the tubular portion 421 can be modified depending on different situations and not limited to the circular tubular shape; the structure of the cover member 40 can be modified depending on demand, only if the two engaging claws 36 in the opened position are accommodatable in connecting hole 44 thereof.

Accordingly, even though the two engaging claws 36 of the transmitting assembly 30 are in the opened position, the two engaging claws 36 still can be accommodated in the connecting hole 44 of the cover member 40 and not interfered with the connecting hole 44. Therefore, during the procedure for mounting the cover member 40 on the side opening 14 of the case body 10, the operator would not need to close the two engaging claws 36, and the cover member 40 still can be mounted on the side opening 14, so that the procedure for mounting the cover member 40 may save time and be convenient.

The above description represents merely the preferred embodiment of the present invention, without any intention to limit the scope of the present invention. The simple variations and modifications not to be regarded as a departure from the spirit of the invention are intended to be included within the scope of the following claims.

What is claimed is:

1. A toner cartridge, comprising:

a case body, having an inner space and a side opening communicated with the inner space and outside;

a photosensitive roller, disposed at the inner space, the photosensitive roller having an imaginary axis;

a transmitting assembly, having a gear member fixed at an end of the photosensitive roller, an axial member provided with an end disposed at the gear member, and two engaging claws rotatably disposed at the other end of the axial member, wherein the gear member and the axial member are coaxial with the photosensitive roller; each of the engaging claws is rotatable between an opened position and a closed position; the each of the engaging claws is provided with a vertex; when the each of the engaging claws is in the opened position, the vertex of the each of the engaging claws is defined with the imaginary axis a maximum distance that is greater than a distance between any other position on the each of the engaging claws and the imaginary axis, and the maximum distance is greater than a distance between any position on the each of the engaging claws and the imaginary axis when the each of the engaging claws is located at the closed position; and a cover member, having a main body disposed at the side opening of the case body and abutted against the gear member, and a connecting hole located at the main body and configured in a way that the axial member is insertable into the connecting hole and the two engaging claws in the opened position are accommodatable in the connecting hole.

2. The toner cartridge as claimed in claim 1, wherein a proximal side of the main body of the cover member adjacent to the gear member has a tubular portion, distal side of the main body away from the gear member has an extending portion, and inner edges of the tubular portion and the extending portion define the connecting hole.

3. The toner cartridge as claimed in claim 2, wherein the gear member has an annular notch into which the tubular portion of the cover member inserts.

4. The toner cartridge as claimed in claim 3, wherein the tubular portion is in a circular tubular shape.

5. The toner cartridge as claimed in claim 4, wherein a nearest distance between the extending portion and the imaginary axis is smaller than or equal to a radius of the inner edge of the tubular portion.

6. The toner cartridge as claimed in claim 2, wherein the tubular portion is in a circular tubular shape.

7. The toner cartridge as claimed in claim 6, wherein a nearest distance between the extending portion and the imaginary axis is smaller than or equal to a radius of the inner edge of the tubular portion.

* * * * *